United States Patent [19]

Hargett et al.

[11] 4,274,690

[45] Jun. 23, 1981

[54] JUMPER CABLE ARRANGEMENT FOR A VEHICLE

[75] Inventors: Jerry D. Hargett; Alfred C. Nash, both of Hilmar, Calif.

[73] Assignee: N & H Manufacturing, Inc., Turlock, Calif.

[21] Appl. No.: 67,559

[22] Filed: Aug. 17, 1979

[51] Int. Cl.[3] ..... H01R 13/44

[52] U.S. Cl. ..... 339/10; 339/130 R; 339/184 R

[58] Field of Search ..... 339/10, 94 A, 94 C, 339/113 L, 126 R, 126 J, 126 RS, 130 R, 130 C, 184 R, 184 M, 94 R

[56] References Cited

U.S. PATENT DOCUMENTS

| | | | |
|---|---|---|---|
| 2,654,077 | 9/1953 | McLoad | 339/184 R |
| 2,713,670 | 7/1955 | Koch | 339/126 J |
| 2,907,976 | 10/1959 | Damon | 339/126 J |
| 3,183,476 | 5/1965 | Sacks et al. | 339/94 R |
| 3,617,986 | 11/1971 | Becker et al. | 339/94 A |
| 3,813,632 | 5/1974 | Drewry | 339/10 |
| 3,850,501 | 11/1974 | Butterfield et al. | 339/94 A |
| 4,146,282 | 3/1979 | Gay | 339/10 |
| 4,174,873 | 11/1979 | Hargett et al. | 339/10 |

*Primary Examiner*—John McQuade

*Attorney, Agent, or Firm*—Lothrop & West

[57] ABSTRACT

A vehicle having a storage battery and a metal body panel has the body panel connected to one of the poles of the storage battery. There are two apertures in the body panel. One aperture receives a conducting bushing having a first head and stem with a relatively large bore therein. An insulating first sleeve extends through one aperture, slips over the stem and is in abutment with the head. An internal groove in the first sleeve adjacent the head receives an insulating washer retained by an inturned head rim. An insulating second washer slips over the stem, abuts the other side of the body panel from the head, and is clamped in place by a nut engaging the first stem. A conductor cable goes from that first stem to one pole of the storage battery and is held in place by a retaining nut. In the second aperture is a second stem having a smaller bore but otherwise similar in construction to the first stem. An insulating second sleeve slips over the second stem but does not enter the second aperture. The second sleeve retains an insulating third washer. A nut of conducting material is threaded onto the stem of the second bushing and abuts the metal body panel. An external conductor having a plug on one end of a large diameter to fit into the first bore also has on the other end a plug of a small diameter to fit into the second bore.

1 Claim, 4 Drawing Figures

JUMPER CABLE ARRANGEMENT FOR A VEHICLE

CROSS-REFERENCES TO RELATED APPLICATIONS

In our copending application entitled "Electrical Connector For A Vehicle" filed Oct. 23, 1978 with Ser. No. 953,571, now U.S. Pat. No. 4,174,873 of Nov. 20, 1979, we disclose an arrangement providing a pair of electrical terminals externally accessible through the metal body panel of a vehicle, the terminals being joined to the poles of the vehicle storage battery.

BRIEF SUMMARY OF THE INVENTION

In practice, it has developed that occasionally users will cross-connect the terminals. They may inadvertently cause the substantial discharge or even polarity reversal of the battery. They may inadvertently cause reverse motion of an outside motor or the like crossing of polarity.

It is therefore an object of our invention to provide an improved arrangement so that the foregoing difficulties can readily be obviated.

A further object of the invention is in general to provide an improved jumper cable arrangement for a vehicle.

These objects are attained by providing, in the vehicle body panel, conducting stems having bushings with bores of different sizes and also suitably disposed, insulated, individualized and connected to the vehicle battery so that correspondingly sized plugs on the connecting cable cannot be improperly plugged in.

DETAILED DESCRIPTION

Figure 1:
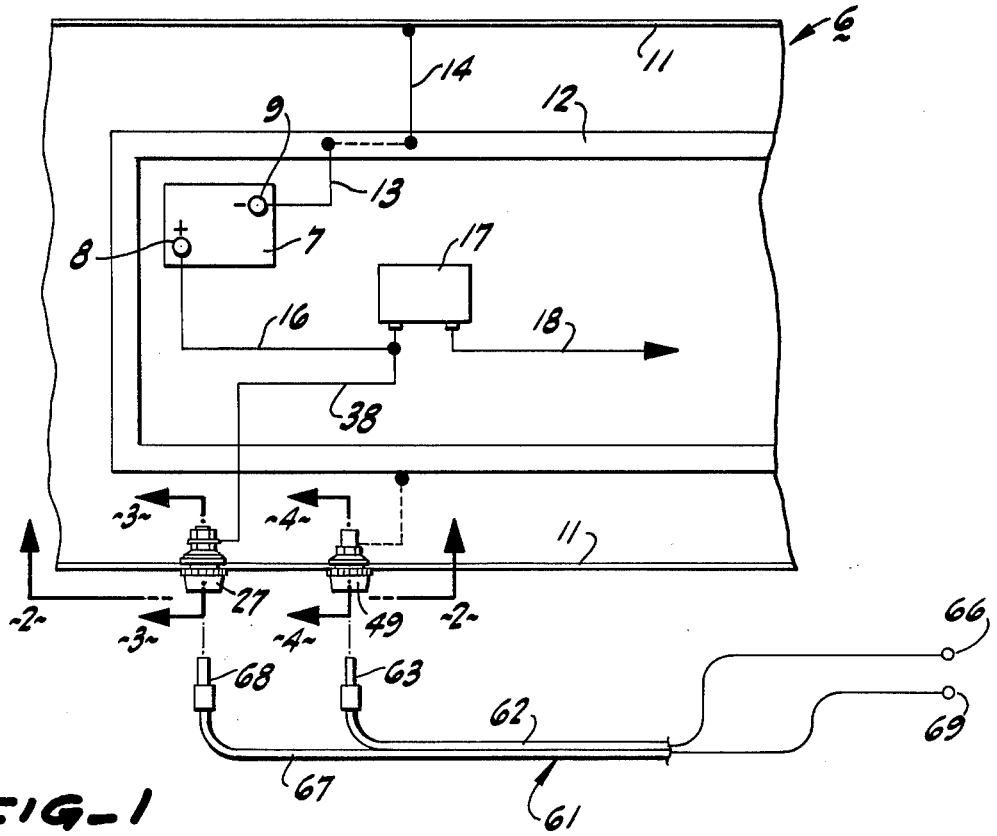
FIG. 1 is partly a representation and partly a diagram showing a typical installation of a jumper cable arrangement in a vehicle, portions being broken away to reduce the figure size.

A typical jumper cable installation is made in a vehicle 6 inclusive of a storage battery 7 having a positive pole 8 and a negative pole 9 and located in the vehicle 6 adjacent the metal vehicle body walls 11.

The vehicle may also include a frame 12 of electrically conducting material, the drawing being representative of any of the customary arrangements. As is usual, the negative pole of the battery is the ground. It is connected to the frame 12 and often also to the body 11 by a connector 13 and a connector 14. The body metal 11 is thus well grounded. The battery positive terminal 8 is joined through a conductor 16 to representative electrical instrumentalities 17 in the vehicle (such as a starter, generator and so on). These may have another conductor 18 extending directly or through some further instrumentality and ultimately to ground.

Figure 3:
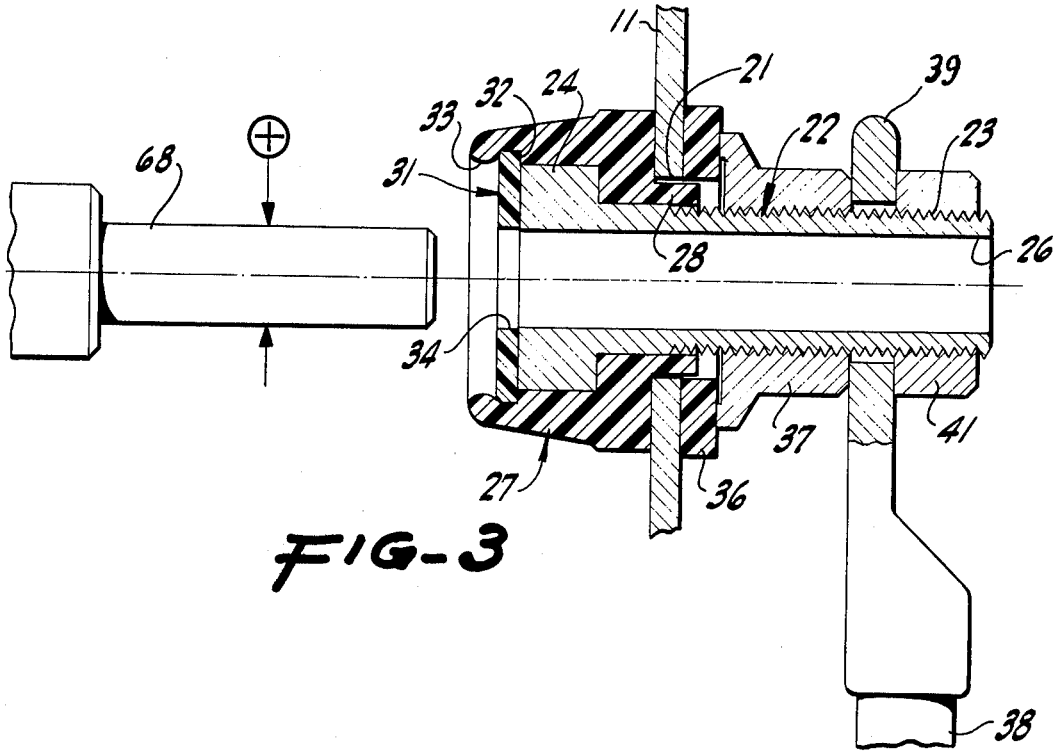
FIG. 3 is a cross-section to an enlarged scale, the plane of section being indicated by the line 3—3 of FIG. 1.
Figure 4:
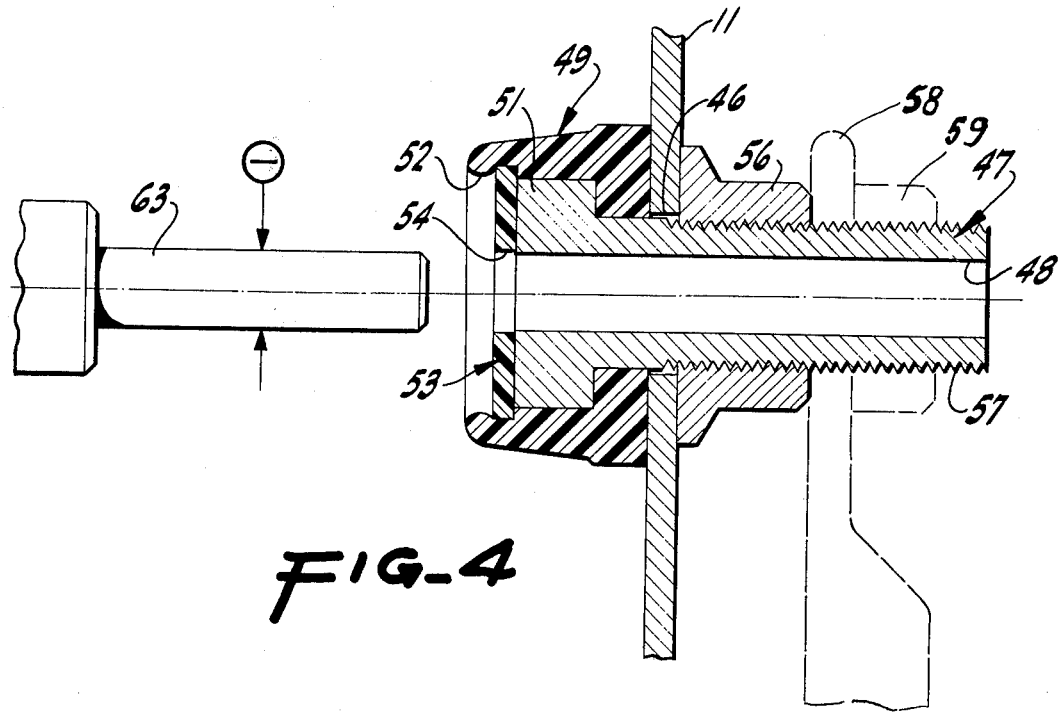
FIG. 4 is a view comparable to FIG. 3 but with the plane of section being taken on the line 4—4 of FIG. 1.

In accordance with the present arrangement, the body 11 (FIG. 3) has a body opening 21 or aperture through which extends a conducting first bushing 22 having external threads 23 on the stem and having a hexagonal or multi-sided, first head 24 at one end. Through the first bushing there extends an opening or passage or bore 26 of a predetermined relatively large diameter.

Nonrotatably surrounding the first head 24 and also a part of the first bushing 22 is an insulating first sleeve 27 having wrench-receiving flats and at one end inturned or reduced in diameter to surround the stem as well as to abut the exterior face of the body panel 11. There is an insulating extension 28 on the sleeve 27 extending through the opening 21 or first aperture and precluding any direct metallic or physical contact between the body panel 11 and the first bushing 22.

The external face of the first head 24 is particularly protected by an overlying insulating washer 31 seated against a shoulder 32 in the head 24. To retain the washer 31 in position, the sleeve 27 has an inturned rim 33 of somewhat resilient material. The sleeve is sized with respect to the washer 31 so that after the bushing 22 and the sleeve 27 have been initially assembled, the washer 31 can be snapped into position. By the resilience of the rim 33, the washer 31 is normally retained in place. The opening 34 within the washer 31 is substantially the same in size or is slightly larger than the bore 26 of the bushing 22. There is thus no easy way to interengage the washer 31 and pull it out once it has been initially assembled.

To retain this mechanism in position and to maintain the insulation thereof, a second, insulating washer 36 is slipped over the stem of the bushing 22 and is positioned around the extension 28 and in contact with the inner side of the body panel 11. An electrically conducting nut 37 is threaded upon the external threads 23 of the bushing 22 and is screwed tightly into position, thus anchoring the parts firmly in place.

The terminal just described is connected to the positive terminal 8 of the storage battery 7 through a conductor 38 (and the conductor 16) of usual form having a terminal 39 that slips over the stem threads 23 and is held in position by a securing nut 41 in the customary way. By these means, there is provided on the outside of the vehicle an end-protected but internally available, positive terminal of an interior diameter of relatively large size.

Quite comparably, although with some differences, the panel 11, usually a few inches away from the location of the aperture 21, is provided with a similar aperture 46. Extending through the aperture 46 is a second, conducting bushing 47 of a construction substantially identical with that of the first bushing 22, except that the internal bore 48 or passage of the bushing 47 is substantially smaller in diameter than the bore 26.

A second insulating sleeve 49 with wrench-receiving flats and fitting nonrotatably over and behind the multi-sided or hexagonal head 51 of the second bushing does not have any extension comparable to the extension 28 and simply abuts the body panel 11. Otherwise, the sleeves 27 and 49 are of comparable construction. That includes a slightly flexible rim 52 or lip that snaps over a closure washer 53 upon assembly and retains the washer 53 in position. A central opening 54 in the washer 53 is considerably smaller than the opening 34 and is of a size comparable to that of the small bore 48.

Preferably, the sleeves 27 and 49 are also different in that they are preferably molded in different-color material to assist the user in visually distinguishing them.

Since the second bushing 47 is grounded, any washer comparable to the washer 36 is omitted. Rather, a conducting nut 56 is screwed upon the threads 57 of the bushing 47 and is tightened against the body panel 11. In this fashion, a good electrical connection is established between the body panel and the second conducting bushing 47. Under some circumstances, the bushing 47 is utilized as a further electrical ground connection. If so, a conductor 58 and a nut 59 somewhat comparable to the nut 56 can be added.

To cooperate with the two adjacent bushings 22 and 47, there is provided a conductor 61 (FIG. 1). This includes a first lead 62 having a terminal plug 63 of a relatively small diameter designed to fit closely into the bore 48. At its other end, the lead 62 extends to an appropriate terminal 66 representing an electrical load or supply. Similarly, the conductor 61 includes a lead 67 having a plug 68 at one end thereof. The lead 67 goes to another terminal 69 paired with the terminal 66 to represent the source of power or an electrical load. The plug 68 is of a diameter much too large to fit into the opening or bore 48, but is of a size to fit snugly and properly into the opening or bore 26 of the positive terminal 22.

With this arrangement, the large plug 68 cannot be introduced into the small opening 48. Even if the small plug 63 is inadvertently put into the large opening 26, it is too small to make an effective electrical contact therewith. When the two plugs 63 and 68 are inserted in the proper bores 26 and 48, the only way they can be, a circuit is completed through the storage battery.

Figure 2:
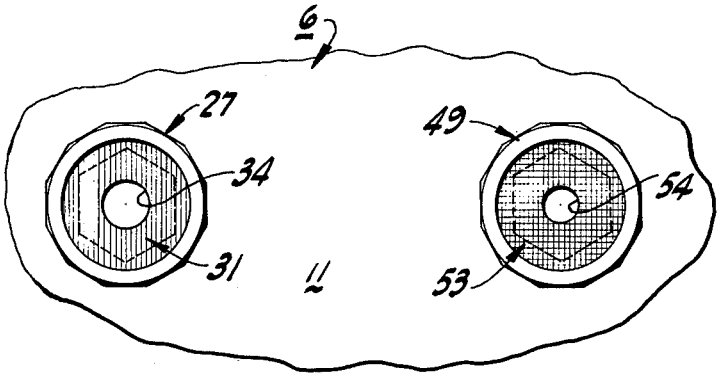
FIG. 2 is a side elevation of part of the vehicle, the plane of which is indicated by the line 2—2 of FIG. 1.

To assist the user not only by the difference in size between the bores 26 and 48 and the stems 63 and 68, it is preferred to make the external surface, at least, of the washers 31 and 53 of different colors, preferably with light-reflecting surfaces, as indicated in FIG. 2. At night, particularly, any incident light makes the washers quite visible. Their different colors greatly assist the proper negative and positive plug-ins being made.

We claim:

1. A jumper cable arrangement for a vehicle having an electrically conducting body panel and a storage battery with two poles comprising means defining a first aperture in said body panel and defining a second aperture in said body panel; a first conducting bushing adapted to extend through said first aperture and having a first head and a stem with a relatively large bore therein; an insulating first sleeve adapted to slip over said first stem and to abut said head, said first sleeve having an internal first groove therein adjacent said first head; a first insulating washer disposed in said first groove and abutting said first head; means for retaining said first washer in said first groove; an insulating second washer around said first bushing and abutting said body panel; means interengaging with said first stem and said second washer for holding said first sleeve against said body panel; means for electrically connecting said first conducting bushing to one pole of said storage battery; a second conducting bushing adapted to extend through said second aperture and having a second head and a second stem and a relatively small bore therein; an insulating second sleeve adapted to slip over said second stem and to abut said second head, said second sleeve having an internal second groove therein; an insulating third washer in said second groove; means for retaining said third washer in said second groove; conducting means interengaging with said second stem and in electrical contact with said body panel for holding said second sleeve against said body panel; means for electrically connecting said body panel to the other pole of said storage battery; and a conductor having a first plug of substantially a relatively large size and adapted to fit into said relatively large bore in said first bushing and having a second plug of substantially a relatively small size and adapted to fit said relatively small bore in said second bushing.

* * * * *